US006271488B1

(12) United States Patent
Sasaki

(10) Patent No.: US 6,271,488 B1
(45) Date of Patent: Aug. 7, 2001

(54) SWITCH MECHANISM

(75) Inventor: Yuji Sasaki, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/453,552

(22) Filed: Dec. 3, 1999

(30) Foreign Application Priority Data

Dec. 4, 1998 (JP) ..... 10-345944
Dec. 4, 1998 (JP) ..... 10-345945

(51) Int. Cl.[7] ..... H01H 9/00; H01H 25/06
(52) U.S. Cl. ..... 200/4; 200/5 R; 200/18
(58) Field of Search ..... 200/5 R, 5 A, 200/4, 17 R, 18, 1 R, 6 A, 11 R–11 TW; 345/157–161; 74/471 XY

(56) References Cited

U.S. PATENT DOCUMENTS 2,841,659 * 7/1958 Eitel ..... 200/6 A
3,293,381 * 12/1966 Eitel ..... 200/6 A
3,360,620 * 12/1967 Ward ..... 200/6 A
3,573,412 * 4/1971 Ulrich ..... 200/4 X
4,823,634 4/1989 Culver ..... 74/471
5,635,926 6/1997 Li ..... 341/20
B1 6,194,673 * 2/2001 Sato et al. ..... 200/4 X
B1 6,198,057 * 3/2001 Sato et al. ..... 200/4

FOREIGN PATENT DOCUMENTS 0588210 3/1994 (EP) ..... H04M/01/02
2260598 4/1993 (GB) ..... H01H/25/00

* cited by examiner

*Primary Examiner*—J. R. Scott
(74) *Attorney, Agent, or Firm*—Jay H. Maioli

(57) ABSTRACT

A switch mechanism includes a control member whose axis of rotation is longitudinal, a pair of supporting members to support the control member rotatably and also movably in a direction perpendicular to the axis of rotation, a first detector to detect a rotation of the control member, a second detector to detect a movement of the control member in a direction perpendicular to the axis of rotation, and a third detector to detect a movement of the control member along the axis of rotation.

7 Claims, 6 Drawing Sheets

SWITCH MECHANISM

BACKGROUND OF THE INVENTION

1. Field of the Invention

The present invention relates to a switch mechanism operable in three different directions.

2. Description of the Related Art

Some conventional pocket or portable telephones use a switch mechanism which can be operated by rotating and pressing and thus serves as one controller. This type of switch mechanism used in such a portable telephone has a control member supported rotatably on a spindle perpendicular to a flat base and linearly movably in relation to the base. The control member is of a circular thin-plate structure designed to compact so as not to esthetically spoil the appearance of the telephone body.

The pocket telephone having such a switch mechanism is adapted to retrieve, by rotating the control member, a desired one of a plurality of telephone numbers stored in a memory incorporated in the telephone body, and transmit the retrieved telephone number by pressing the control member.

Some recently available pocket telephones have many functions including, in addition to the telephoning function, functions of composing a short sentence, transmitting it via electronic mail (E-mail) and receiving such a sentence via E-mail. As the pocket telephone is designed to have an increased number of functions, it should be provided with a correspondingly increased number of function control keys for performing the functions. The functions are to be performed by operating many combinations each of a plurality of control keys including the function control keys and dial keys. Therefore, because of the increased number of functions, the multi-functional pocket telephone cannot be designed compact and operated easily. Also, if the pocket telephone is designed to perform a function by operating a combination of a plurality of control keys, the operation itself is complicated. Anyway, the conventional multi-functional pocket telephones have no easy operability.

Also, since the control member used in the switch mechanism of the pocket telephone is of the circular thin-plate structure, it is not easy to operate.

OBJECT AND SUMMARY OF THE INVENTION

Accordingly, the present invention has an object to overcome the above-mentioned drawbacks of the prior art by providing an improved and novel switch mechanism operable in three different directions, permitting to perform many functions, easily operable and also permitting to design compact a main body of a pocket telephone or the like in which the switch mechanism is employed.

The above object can be attained by providing a switch mechanism comprising according to the present invention:

a rotatable control member;

means for supporting the control member rotatably and also movably in a direction perpendicular to the axis of rotation of the control member as well as along the axis of rotation;

a first detector to detect a rotation of the control member;

a second detector to detect a movement of the control member in the direction perpendicular to the axis of rotation of the control member; and a third detector to detect a movement of the control member along the axis of rotation of the control member.

According to one aspect of the present invention, the supporting means includes supporting members for supporting the control member rotatably and movably in the direction perpendicular to the axis of rotation of the control member and a movement guide mechanism for supporting the control member movably along the axis of rotation of the control member, and when the switch mechanism is operated to move the control member along the axis of rotation of the control member, the supporting members move along the axis of rotation of the control member and the third detector detects the movement of the supporting member.

According to another aspect of the present invention, the supporting means includes a shaft portion which is inserted into a through-hole formed in the control member along the axis of rotation of the latter and supporting members for supporting the shaft portion rotatably, and one of the shaft portion and through-hole has a guide recess formed therein along the axis of rotation of the control member while the other of the shaft portion and through-hole has formed thereon a projection which is engaged in the guide recess.

These objects and other objects, features and advantages of the present intention will become more apparent from the following detailed description of the preferred embodiments of the present invention when taken in conjunction with the accompanying drawings.

DETAILED DESCRIPTION OF THE PREFERRED EMBODIMENTS

Figure 1:
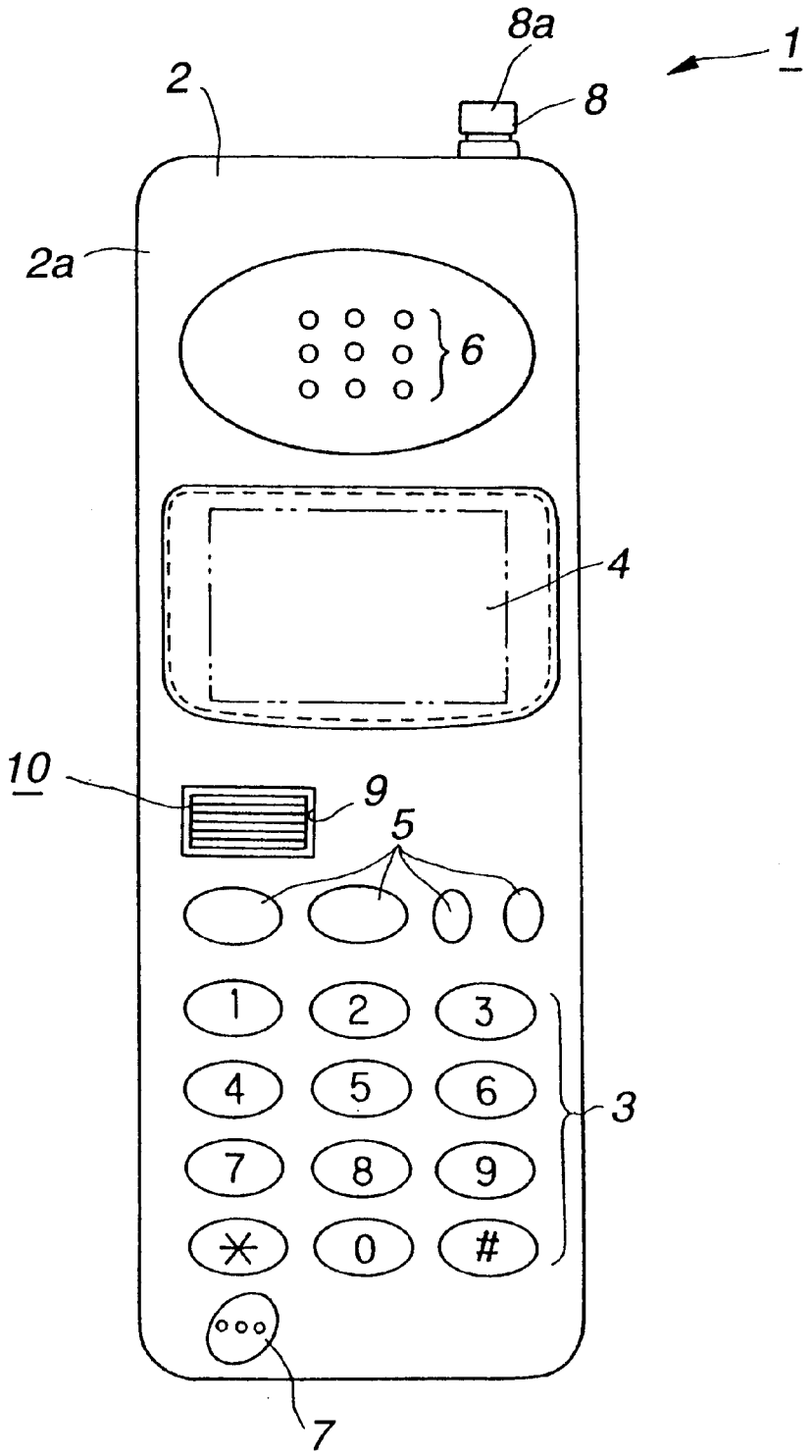
FIG. 1 is a front view of a pocket telephone in which an embodiment of the switch mechanism according to the present invention is employed.

The switch mechanism according to the present invention which is employed in a pocket telephone will be described as a nonlimitative example herebelow:

Referring now to FIG. 1, there is illustrated a pocket telephone in which an embodiment of the switch mechanism according to the present invention is employed. The pocket telephone is generally indicated with a reference 1, and the switch mechanism is generally indicated with a reference 10. As shown, the pocket telephone 1 has a handset-like cabinet 2 as a telephone body in which a telephone circuit, speaker/transmitter and receiver/earpiece are built in. The cabinet 2 as a whole is formed generally rectangular to have such a size that it can be held in one hand. The cabinet 2 has a front face 2*a* being a control panel on which dial keys 3 including a plurality of pushbuttons and a display 4 made of a crystal display device to display a telephone number recorded in a memory incorporated in the pocket telephone 1 and an operating state of the pocket telephone 1. The display 4 is disposed nearly in the middle of the length of the cabinet 2. The dial keys 3 are disposed below the display 4. Function control keys 5 are provided between the display 4 and dial keys 3. The function control keys 5 are used to control the functions of the pocket telephone 1.

Further, there are formed in the front face 2*a* of the cabinet 2 receiver holes 6 being a plurality of small holes located opposite to a diaphragm of the receiver/earpiece built in the cabinet 2 and speaker holes 7 being a plurality of small holes located opposite to a diaphragm of the speaker/transmitter also built in the cabinet 2. The receiver holes 6 are located in an upper front portion of the cabinet 2 while the speaker holes 7 are located in a lower front portion of the cabinet 2. The receiver holes 6 and speaker holes 7 are thus separated from each other by a distance nearly corresponding to a distance between the human ear and mouth. The distance between the receiver and speaker holes 6 and 7 is set such that when the user holds the cabinet 2 of the pocket telephone 1 in one hand with the receiver holes 6 being placed near the ear, the speaker holes 7 can be placed near the mouth and collect a speech of the user of the pocket telephone 1.

Further, the pocket telephone 1 is provided with a telescopic transmission/reception antenna 8 having a head portion 8*a* located outside near one lateral corner of the upper end of the cabinet 2. The antenna 8 can be extended by drawing out the head portion 8*a* thereof from the cabinet 2.

Furthermore, a switch mechanism 10 is provided between the display 4 and function control keys 5 and in a position near the lateral side of the cabinet 2 opposite to the lateral side near which the antenna 8 is provided. The switch mechanism 10 is used to control input to, and functions of, the speaker/transmitter and receiver/earpiece built in the pocket telephone 1. Because of the location of the switch mechanism 10 (between the display 4 and function control keys 5 and in the position near the lateral side of the cabinet 2 opposite to the lateral side near which the antenna 8 is provided), the pocket telephone 1 can be operated while being held in one hand.

Figure 2:
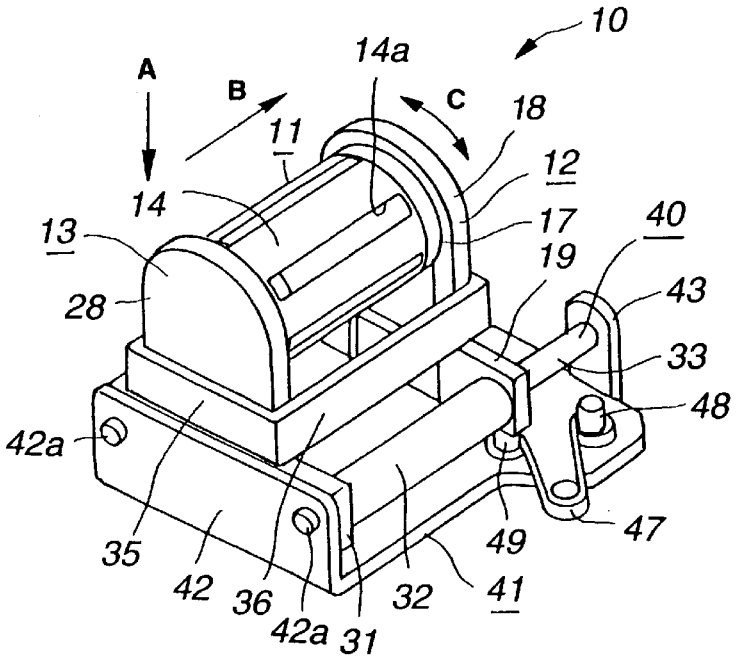
FIG. 2 is a perspective view of the switch mechanism.
Figure 3:
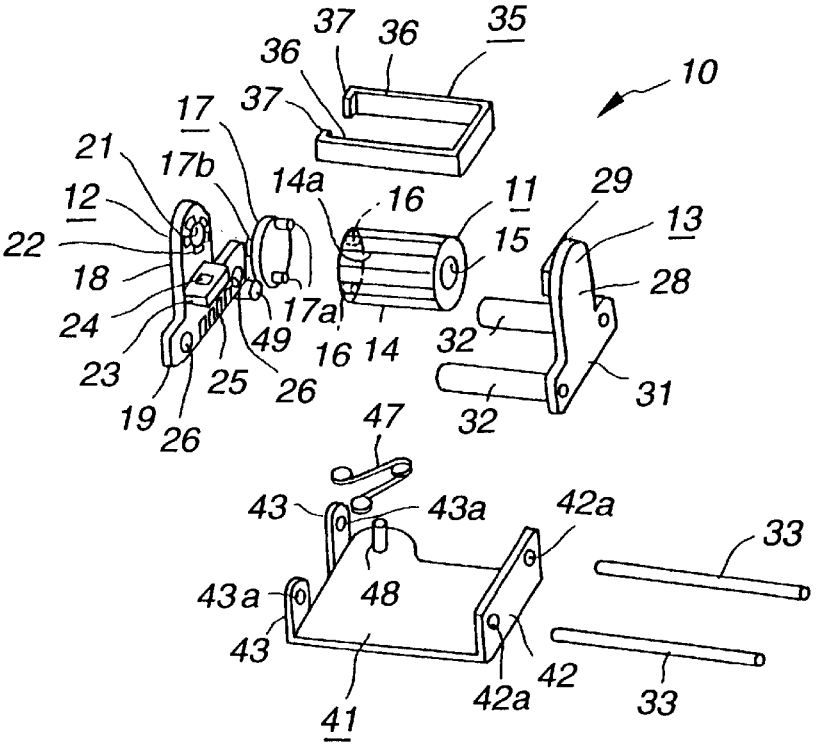
FIG. 3 is an exploded perspective view of the switch mechanism in FIG. 2.

FIG. 2 is a perspective view of the switch mechanism 10, and FIG. 3 is an exploded perspective view of the switch mechanism 10 in FIG. 2. As shown in FIGS. 1 through 3, the switch mechanism 10 comprises a control member 11 provided and exposed in an opening 9 formed in the front face 2*a* of the cabinet 2 between the display 4 and function control keys 5 and in the position near the lateral side opposite to the lateral side near which the antenna 8 is provided, and supporting members 12 and 13 to support the control member 11.

Figure 4:
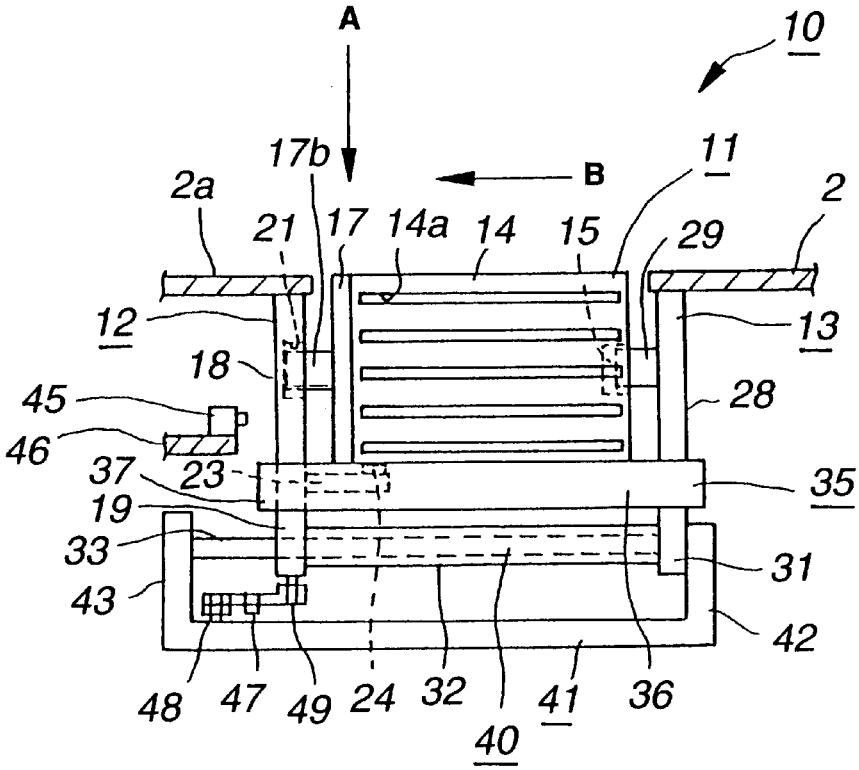
FIG. 4 is a side elevation of the switch mechanism installed in a pocket telephone.

As best shown in FIGS. 2 and 3, the control member 11 as a whole is formed generally cylindrical and has an axis of rotation extending longitudinally thereof. The control member 11 includes a body 14 operable with the finger or the like. The body 14 has formed on the outer surface thereof engraved recesses 14*a* which will permit an easier rotation of the body 14. The body 14 has formed in one longitudinal end thereof a bearing hole 15 in which a shaft portion of the supporting member 12 is engaged. The bearing hole 15 is formed larger in diameter than the shaft portion of the supporting member 12 as shown in FIG. 4. Also, the control member 11 has formed in the other longitudinal end thereof bearing bores 16 for fixation of a rotation detector 17 which detects a rotation of the control member 11.

The rotation detector 17 to detect a rotation of the control member 11 is fixed to the other longitudinal end of the control member 11. The rotation detector 17 has provided on a side thereof opposite to the supporting member 12 a contact shoe (not shown) which is to be in sliding contact with contacts (not shown) provided on a side of the supporting member 12 opposite to the rotation detector 17. Also, the rotation detector 17 has provided on a side thereof opposite to the one end face of the control member 11 engagement pieces 17*a* which are fixed to the control member 11. The engagement pieces 17*a* are engaged in the bearing bores 16 formed in the other longitudinal end of the control member 11, and thus the rotation detector 17 is rotatable with the control member 11. Moreover, the rotation detector 17 has provided in the center of a side thereof opposite to the supporting member 12 a projecting spindle 17*b* which is engaged in a bearing hole 21 formed in the supporting member 12. The spindle 17*b* is formed to have a smaller outside diameter than the diameter of the bearing hole 21 formed in the supporting member 12. Since the spindle 17*b* has the smaller outside diameter than the diameter of the bearing hole 21 in the supporting member 12, it is loose-fitted in the bearing hole 15 movably in a direction perpendicular to the axis of rotation of the control member 11.

Since the spindle 17*b* is loose-fitted in the bearing hole 15 and thus the control member 11 is supported loosely on the supporting members 12 and 13, the control member 11 is rotatable forward and backward and movable in the direction perpendicular to the axis of rotation of the control member 11, namely, in the direction of arrow A shown in FIGS. 2 and 4 and also in a direction opposite to the direction of arrow A.

As shown in FIGS. 2 and 3, the supporting member 12 supporting the control member 11 consists of a supporting portion 18 to support the control member 11 and a circuit portion 19 provided with detectors to detect a rotation and movement of the control member 11 and terminals for supplying control signals from the detectors to an external circuit. The supporting portion 18 is located at the free end of the supporting member 12. As mentioned above, the supporting portion 18 has formed nearly in the center thereof the bearing hole 21 in which the spindle 17*b* is engaged movably in the direction of arrow A in FIGS. 2 and 4 and also in the direction opposite to the direction A. As mentioned previously, the spindle 17*b* is provided on the rotation detector 17 installed on the other longitudinal end of the control member 11 to detect a rotation of the control member 11. The bearing hole 21 is formed larger in diameter than the shaft portion of the rotation detector 17 so that it bears the control member 11 rotatably and also movably in the direction perpendicular to the axis of rotation of the control member 11.

There is provided along the circumference of the bearing hole 21 a plurality of contacts 22 which are electrically connected to the rotation detector 17 which detects a rotation of the control member 11. The contact shoe of the rotation detector 17 is in selective contact with the contacts 22.

As shown in FIGS. 2 and 3, the circuit portion 19 of the supporting member 12 has a support base 23 provided thereon at the base of the supporting member 12 and in a position which nearly corresponds to the lower end of the control member 11 when the latter is supported on the support base 23 during assembling. The support base 23 is provided to support a pressure detector 24 which detects a movement of the control member 11 in the direction perpendicular to the axis of rotation of the control member 11. The support base 23 is projected longitudinally of the control member 11. The pressure detector 24 is disposed on a side of the support base 23 opposite to the control member 11. When the control member 11 is pressed, the other longitudinal end of the body 14 is put into contact with, and thus presses, the pressure detector 24.

Also, the circuit portion 19 is provided at the base thereof with terminals 25 via which control signals are supplied from the rotation detector 17 and pressure detector 24 to a control circuit of the pocket telephone 1. The terminals 25 are electrically connected to the contacts 22 and pressure detector 24 by a wiring pattern (not shown) buried in the supporting member 12. Further, the circuit portion 19 has formed in either lateral end portion thereof a guide hole 26 which guides the control member 11 moving along the axis of rotation of the control member 11.

The supporting member 13 supporting, together with the supporting member 12, the control member 11 has a supporting portion 28 which cooperates with the supporting portion 18 of the supporting member 12 to support the control member 11. The supporting portion 28 has provided nearly in the center thereof a spindle 29 which is engaged in the bearing hole 15 in the control member 11. The spindle 29 is formed to have a smaller outside diameter than the diameter of the bearing hole 15. Thus, the spindle 28 is freely movable in a direction perpendicular to the axis of rotation of the control member 11.

The supporting member 13 is provided at the base thereof with a guide support 31 to move the control member 11 along the axis of rotation of the control member 11. The guide support 31 has a guide 32 provided at either lateral end thereof. The guides 32 are formed like a cylinder extending in the same direction as the projecting direction of the spindle 29. The guides 32 are engaged at the free ends thereof into the guide holes 26 in the supporting member 12 when the control member 11 is supported on the supporting members during assembling. Guide shafts 33 to guide the control member 11 moving along the axis of rotation of the control member 11 are inserted into the guide holes 26 and guides 32.

The control member 11, supporting members 12 and 13 are assembled together using a fastening member 35. The fastening member 35 as a whole has a generally C form. It consists of a pair of arms 36 each having an engagement end 37 as shown in FIGS. 2 and 3. The engagement ends 37 retain the control member 11 supported on the supporting members 12 and 13. The arms 37 are formed to be elastically deflectable towards and away from each other. The fastening member 35 fastens the supporting members 12 and 13 with the spindle 29 of the supporting member 13 being engaged in the bearing hole 15 in the control member 11 and the spindle 17*b* of the rotation detector 17 fixed to the control member 11 being engaged in the bearing hole 21 in the supporting member 12. That is, the fastening member 35 fastens the supporting members 12 and 13 on which the control member 11 is supported with the engagement ends 37 being engaged on the lateral edges, respectively, of the supporting member 12 as well as with the fastening member 35 being hooped on the supporting members 12 and 13 as a whole.

The supporting members 12 supporting the control member 11 with the fastening member 35 being hooped on them are installed on a movement guide mechanism 40 provided on a base plate 41 as shown in FIGS. 2 and 3 to be movable along the axis of rotation of the control member 11, namely, in a direction of arrow B in FIGS. 2 and 4 and in an direction opposite to the direction of arrow B. The base plate 41 has a rising wall 42 formed along the lateral edge thereof perpendicular to the moving direction of the supporting members 12 and 13, and a pair of rising pieces 43 along the lateral edge thereof opposite to the rising wall 42.

As shown in FIGS. 2 to 4, the movement guide mechanism 40 provided on the base plate 41 comprises the pair of guide shafts 33 to guide the supporting members 12 and 13 moving along the axis of rotation of the control member 11, namely, in the direction of arrow B in FIGS. 2 and 4 and in the direction opposite to the direction of arrow B, the guides 32 in which the guide shafts 33 are inserted, fixing holes 42*a* formed in the rising wall 42 and in which the guide shafts 33 inserted in the guides 32 and guide holes 26 are fixed at one end thereof, and fixing holes 43*a* formed in the rising pieces 43 and in which the guide shafts 33 are fixed at the other end thereof. With the guide shafts 33 inserted in the guides 32 and guide holes 26 being fixed at one end thereof in the fixing holes 42*a* and the guide shafts 33 being fixed at the other end thereof in the fixing holes 43*a*, the movement guide mechanism 40 supports the supporting members 12 and 13, on which the control member 11 is supported and also the fastening member 35 is hooped, to be movable along the axis of rotation of the control member 11, that is, in the direction of arrow B in FIGS. 2 and 4 and in the direction opposite to the direction of arrow B.

Also, the movement guide mechanism 40 comprises a forcing member 47 which provides a detent (clicking) when the user of the pocket telephone 1 moves the control member 11 in the direction of arrow B in FIGS. 2 and 4 and in the direction opposite to the direction of arrow B. The forcing member 47 is a torsion spring, for example, whose one end rests on an engagement projection 48 provided on the base plate 41 while the other end rests on an engagement projection 49 provided on the supporting member 13. Thus, the forcing member 47 forces the supporting members 12 and 13 on which the control member 11 is supported, in the direction of arrow B in FIGS. 2 and 4.

As shown in FIG. 4, the switch mechanism 10 comprises a movement detector 45 to detect a movement of the supporting members 12 and 13 supporting the control member 11, in the direction of arrow B in FIGS. 2 and 4 and in the direction opposite to the direction of arrow B. The movement detector 45 is installed on a base plate 46 provided integrally with the cabinet 2. It is disposed in a position where it is pressed by the supporting member 12. As the supporting members 12 and 13 supporting the control member 11 are moved in the direction of arrow B in FIGS. 2 and 4, the movement detector 45 is pressed by the supporting member 12. At this time, it detects the movement of the supporting members 12 and 13 supporting the control member 11.

The switch mechanism 10 constructed as described in the above is assembled as will be described below:

In the switch mechanism 10, the control member 11 is supported on the supporting members 12 and 13 with the engagement pieces 17*a* of the rotation detecting member 17 being engaged in the bearing bores 16 formed in the other longitudinal end face thereof. More specifically, the spindle 17*b* of the rotation detector 17 installed to the control member 11 is engaged in the bearing hole 21 in the supporting member 12, and the spindle 29 of the supporting member 13 is engaged in the bearing hole 15 in the control member 11. The fastening member 35 whose arms 36 are elastically deflected away from each other, is fitted or hooped onto the supporting members 12 and 13 on which the control member 11 is supported, and then the engagement ends 37 of the arms 36 elastically deflected towards each other are engaged on the lateral edges of the supporting member 12. Thus the control member 11 and supporting members 12 and 13 assembled together as in the above, form a control unit. In this control unit, the guide shafts 33 are inserted in the guides 32 and guide holes 26. By fixing the ends of the guide shafts 33 in the fixing holes 42*a* formed in the rising wall 42 of the base plate 41 and fixing holes 43*a* formed in the rising pieces 43, the control unit is fixed to the base plate 41. Then, the forcing member 47 is installed with one end thereof being engaged on the engagement projection 48 provided on the base plate 41 and the other end being engaged on the engagement projection 49 provided on the supporting member 13. Thus, the control unit is forced in the direction opposite to the direction of arrow B in FIGS. 2 and 4. Note that for the user to feel a click each time the control member 11 is pressed in the direction of arrow A in FIGS. 2 and 4, the control member 11 may be forced by a forcing member such as a torsion spring in the direction opposite to the direction of arrow A in FIGS. 2 and 4.

In the switch mechanism 10 assembled as in the above, the supporting members 12 and 13 on which the control member 11 is supported are forced in the opposite direction to the direction of arrow B in FIG. 4, not pressing the movement detector 45 as shown in FIG. 4. First in this condition, the control member 11 can be rotated reciprocally, namely, in the directions of arrow C in FIG. 2. As the control member 11 is rotated, the contact shoe of the rotation detector 17 gets in contact with the contacts 22 on the supporting member 12 to provide a first control signal corresponding to the rotation of the control member 11 to the terminals 25 via which it is supplied to the control circuit in the pocket telephone 1. Thus, the rotation of the control member 11 can be detected.

Also the control member 11 can be pressed in the direction of arrow A in FIGS. 2 and 4 perpendicular to the axis of rotation thereof. Since the spindles 17*a* and 29 are loose-fitted in the bearing holes 21 and 15, respectively, the control member 11 is allowed to move in the direction of arrow A in FIGS. 2 and 4 and will press the pressure detector 24. When the control member 11 presses the pressure detector 24 as it is moved in the direction of arrow A in FIGS. 2 and 4, a second control signal corresponding to the movement of the control member 11 in the direction of arrow A in FIGS. 2 and 4 is supplied to the terminals 25 via which it is supplied to the control circuit of the pocket telephone 1. Thus, the movement of the control member 11 is detected.

Further, the functional mode of the pocket telephone 1 can be changed from one to another by moving the control member 11 of the switch mechanism 10 along the axis of rotation thereof, that is, in the direction of arrow B in FIGS. 2 and 4. More particularly, as the control member 11 is moved in the direction of arrow B in FIGS. 2 and 4, it presses the movement detector 45, and then it is forced by the forcing member 47 in the direction of arrow B in FIGS. 2 and 4. When the movement detector 45 is pressed by the control member 11 moved in the direction of arrow B in FIGS. 2 and 4, it provides to the control circuit in the pocket telephone 1 a third control signal corresponding to the movement of the control member 11 in the direction of arrow B in FIGS. 2 and 4. Even in this condition, the control member 11 can be moved in the directions of arrows A and B in FIGS. 2 and 4, and also it can be rotated in the directions of arrow C in FIG. 4.

The aforementioned switch mechanism 10 uses the control member 11 whose the axis of rotation extends longitudinally. Thus, the control member 11 can be designed large for easier operability. Also, since in the switch mechanism 11, the control member 11 is supported at the opposite longitudinal ends thereof on the supporting members 12 and 13, and so, even when it is pressed, no excessive force will be applied to the spindles 17*b* and 29. Therefore, the control member 11 can be prevented from being disengaged from the supporting members 12 and 13. Further, since in the switch mechanism 10, all the electronic parts such as the rotation detector 17, pressure detector 24, movement detector 45, terminals 25, etc. are disposed on the supporting member 12, the switch mechanism 10 can be designed simple and compact. Furthermore, since the switch mechanism 10 can be operated in the aforementioned three different directions, many functions can be selected by the single controller.

The pocket telephone 1 provided with the switch mechanism 10 having been described in the foregoing, is used as will be described below:

For transmission of a speech, the dial keys 3, for example, are used to enter a destination telephone number. Then, the control member 11 of the switch mechanism 10 is pressed in the direction of arrow A in FIGS. 2 and 4. The entered destination telephone number can be transmitted from the pocket telephone 1.

For selection of a desired one of the telephone numbers recorded in the memory built in the pocket telephone 1, the control member 11 of the switch mechanism 10 is rotated in the directions of arrow C in FIG. 2. As the control member 11 is rotated, the contact shoe of the rotation detector 17 is put into contact with the contacts 22 on the supporting member 12 to provide the first control signal corresponding to the rotation of the control member 11 to the terminals 25 via which it is supplied to the control circuit in the pocket telephone 1. Thus, the rotation of the control member 11 can be detected. After that, the selected destination telephone number can be transmitted by pressing the control member 11 in the direction of arrow A in FIGS. 2 and 4. When the control member 11 presses the pressure detector 24 as it is moved in the direction of arrow A in FIGS. 2 and 4, the second control signal corresponding to the movement of the control member 11 in the direction of arrow A in FIGS. 2 and 4 is supplied to the terminals 25 via which it is supplied to the control circuit of the pocket telephone 1. Thus, the movement of the control member 11 is detected.

Also, the pocket telephone 1 is adapted to select a desired one of the functions such as electronic mail, data transmission and reception by moving the control member 11 in the direction of arrow B in FIGS. 2 and 4. More specifically, when the movement detector 45 is pressed by the control member 11 moved in the direction of arrow B in FIGS. 2 and 4, it provides the third control signal corresponding to the movement of the control member 11 in the direction of arrow B in FIGS. 2 and 4 to the control circuit in the pocket telephone 1. Thereafter, the pocket telephone 1 can work in a selected one of the modes of operation such as E-mail composition, transmission or reception by moving the control member 11 in the directions of arrows A and B in FIGS. 2 and 4.

The aforementioned switch mechanism 10 uses the control member 11 whose axis of rotation extends longitudinally. Thus, the control member 11 can be designed large for easier operability. Also, owing to the switch mechanism 10 of the pocket telephone 1 that can be operated in three different directions, any one of functions provided in the pocket telephone 1 can easily be selected. Namely, the pocket telephone 1 is very easy to operate. Also, since in the switch mechanism 10 of the pocket telephone 1, the control member 11 is supported at the opposite longitudinal ends thereof on the supporting members 12 and 13, and so, even when it is pressed, no excessive force will be applied to the spindles 17*b* and 29. Therefore, the control member 11 can be prevented from being disengaged from the supporting members 12 and 13. Further, since in the switch mechanism 10, the rotation detector 17, pressure detector 24 and the movement detector 45 are disposed on the supporting member 12, the switch mechanism 10 can be designed simple and compact, which will lead to a compact design of the pocket telephone 1.

Figure 5:
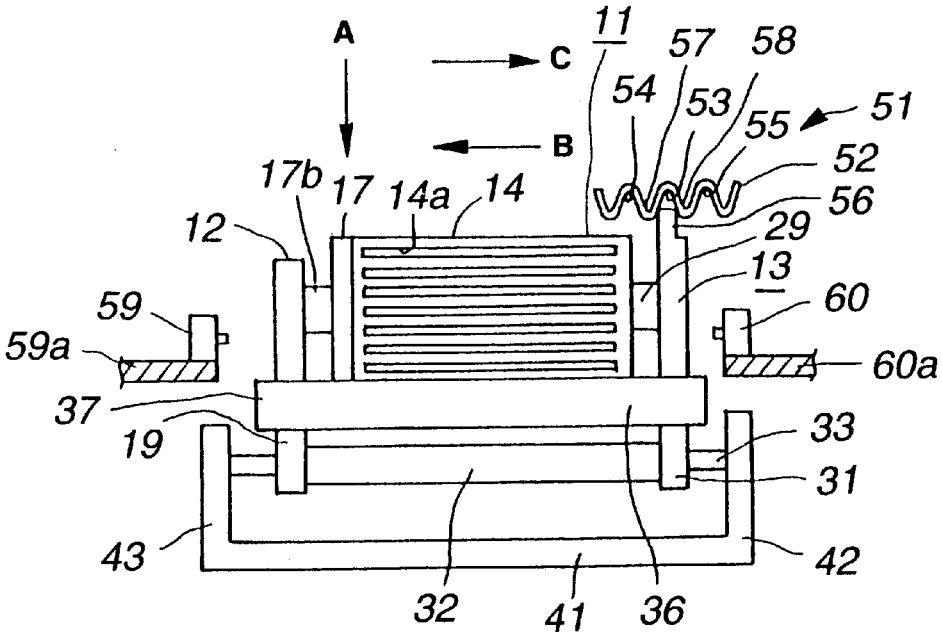
FIG. 5 is a side elevation of a variant of the switch mechanism in FIG. 1.

Referring now to FIG. 5, there is illustrated a variant of the switch mechanism 10 having been described in the foregoing. This switch mechanism is generally indicated with a reference 51. The switch mechanism 51 is characterized in that the control member 11 can be moved in three steps along the axis of rotation thereof. Note that in FIG. 5, the same members as those in the switch mechanism 10 are indicated with the same reference numerals as in FIGS. 2 to 4 and they will not be described any further.

As shown in FIG. 5, the switch mechanism 51 comprises a leaf spring 52 in place of the forcing member 47 of the switch mechanism 10 having previously been described. The free end of the supporting member 13 is engaged on the leaf spring 52. The leaf spring 52 has an engagement concavity 53 at the middle thereof and also engagement concavities 54 and 55 adjacent to the engagement concavity 53. These engagement concavities 53, 54 and 55 are formed by folding the leaf spring 52. The free end of the supporting member 13 is terminated by a projection 56. The projection 56 is engaged in a selected one of the concavities 53, 54 and 55. That is to say, as the supporting members 12 and 13 supporting the control member 11 are moved along the axis of rotation of the latter, namely, in the directions of arrows B and C in FIG. 5, the projection 56 will elastically deflect a projection 57 formed between the engagement concavities 53 and 54 of the leaf spring 52 and also a projection 58 formed between the engagement concavities 53 and 55, and be thus engaged into a selected one of the engagement concavities 53, 54 and 55. Thus, in the switch mechanism 51, when the supporting members 12 and 13 supporting the control member 11 are moved in the directions of arrows B and C in FIG. 5, they will provide a detent (clicking).

Also, the switch mechanism 51 comprises movement detectors 59 and 60 to detect the positions of the supporting members 12 and 13, respectively, on which the control member 11 is supported. The movement detector 59 is supported on a base 59*a* formed integrally with the cabinet 2, and pressed by the supporting member 12 when the supporting members 12 and 13 supporting the control member 11 are moved in the direction of arrow B in FIG. 5. The movement detector 60 is supported on a base 60*a* formed integrally with the cabinet 2, and pressed by the supporting member 13 when the supporting members 12 and 13 supporting the control member 11 are moved in the direction of C in FIG. 5. Thus, the movement detector 59 will detect that the projection 56 is engaged in the engagement concavity 54 (first position), while the movement detector 60 will detect that the projection 56 is engaged in the engagement concavity 55 (second position). When the supporting members 12 and 13 supporting the control member 11 are in their respective neutral positions with the projection 56 being engaged in the engagement concavity 53, the movement detectors 59 and 60 are not pressed.

In the switch mechanism 51 constructed as described in the above, the control member 11 can be rotated reciprocally, namely, in the directions of arrow C in FIG. 1 as in the switch mechanism 10 having previously been described. Also, in the switch mechanism 51, the control member 11 can be pressed in the direction of arrow A in FIG. 5 perpendicular to the axis of rotation thereof. Further, in the switch mechanism 51, the control member 11 can be moved in the directions of arrows B and C in FIG. 5. That is in the switch mechanism 51, when the supporting members 12 and 13 supporting the control member 11 are moved in the direction of arrow B in FIG. 5 from their respective neutral positions where the projection 56 of the supporting member 13 is engaged in the engagement concavity 53, the projection 56 will elastically deflect the projection 57 of the leaf spring 52, and be engaged into the engagement concavity 54. At this time, the user will feel a click when the projection 57 is elastically deflected by the projection 56. The movement detector 59 is pressed by the supporting member 12, and detects that the supporting members 12 and 13 supporting the control member 11 are in their respective first positions.

When the supporting members 12 and 13 supporting the control member 11 are moved in the direction of arrow C in FIG. 5 from their respective neutral positions where the projection 56 is engaged in the engagement concavity 53, the projection 56 will elastically deflect the projection 58 of the leaf spring 52 and be engaged into the engagement concavity 55. At this time, the user will feel a click when the projection 58 is elastically deflected by the projection 56. The movement detector 60 is pressed by the supporting member 13, and detects that the supporting members 12 and 13 supporting the control member 11 are in their respective second positions.

When the supporting members 12 and 13 supporting the control member 11 are in their respective neutral positions, both the movement detectors 59 and 60 are not pressed. Also, when the supporting members 12 and 13 supporting the control member 11 are moved from their respective first or second position to their neutral positions, the projections 56 and 58 are elastically deflected, providing a detent.

The aforementioned switch mechanism 51 forms one controller for the pocket telephone 1. By moving the control member 11 in a selected one of the three different directions, it is possible to select a desired one of the functions of the pocket telephone 1. As any one of the neutral, first and second positions can be selected by moving the control member 11 in any of the directions of arrows B and C in FIG. 5, many functions of the pocket telephone 1 can selectively be used by operating the single controller.

Referring now to FIGS. 6 through 9, there is illustrated another variant of the previously described switch mechanism 10 used in the pocket telephone 1. This switch mechanism is generally indicated with a reference 61. This switch mechanism 61 comprises a control member 62 having formed longitudinally through it a bearing hole in which a spindle is inserted. The control member 62 is supported movably on the spindle.

Figure 6:
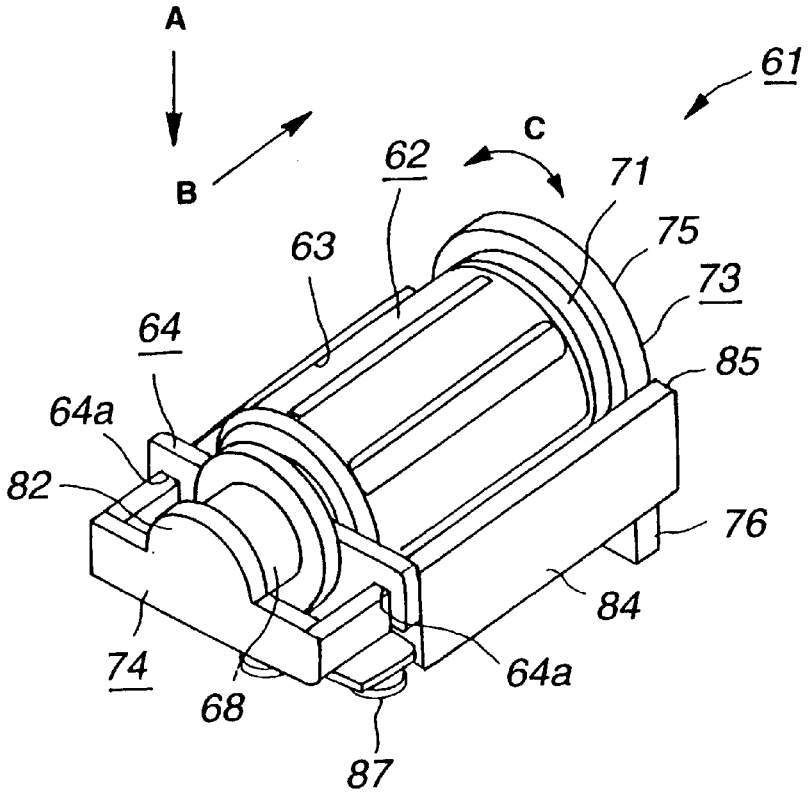
FIG. 6 is a perspective view of another variant of the switch mechanism in FIG. 1.
Figure 7:
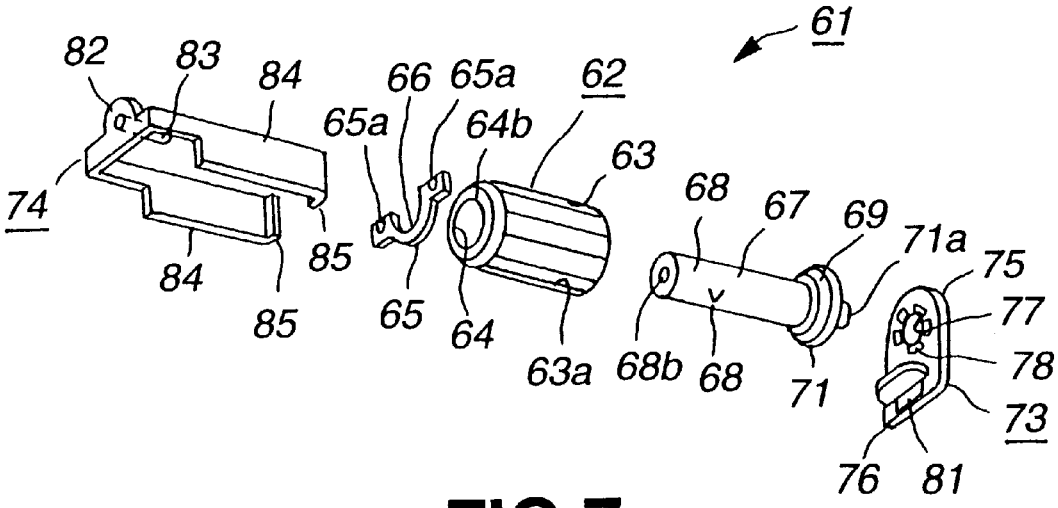
FIG. 7 is an exploded perspective view of the switch mechanism in FIG. 6.
Figure 8:
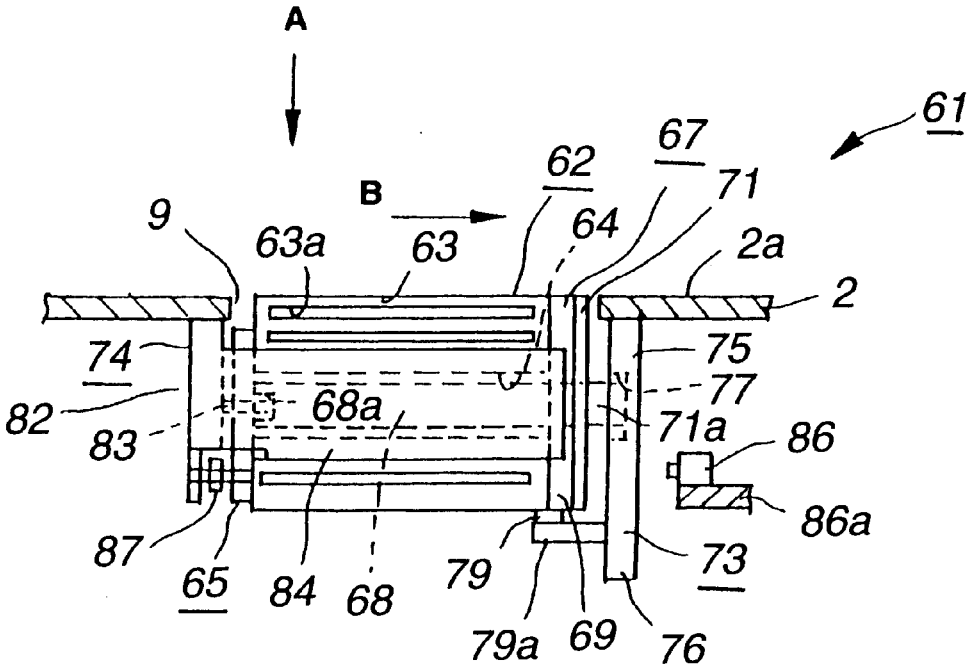
FIG. 8 is a side elevation of the switch mechanism installed in a pocket telephone.
Figure 9:
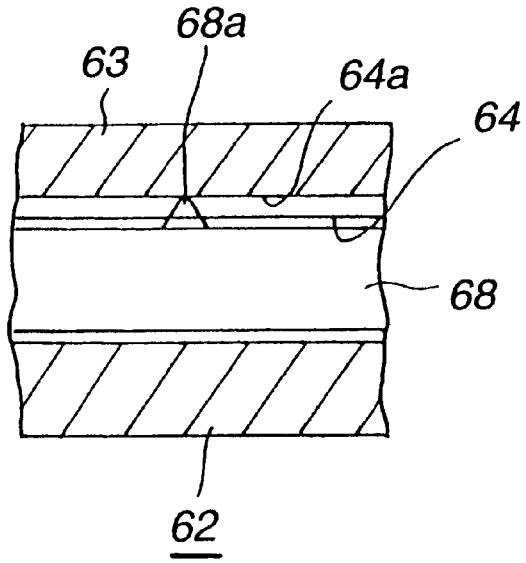
FIG. 9 is a sectional view of a variant of the control member used in the switch mechanism in FIG. 6.

As shown in FIGS. 6 thru 8, the control member 62 of the switch mechanism 61 is provided and exposed in the opening 9 located between the display 4 and function control keys 5 on the front side of the cabinet 2 and in the position near the lateral side opposite to the lateral side near which the antenna 8 is provided as having previously been described. The control member 62 consists of a body 63 formed generally cylindrical and operable by the finger or the like. The body 63 has formed on the outer surface thereof engraved recesses 63*a* which will permit an easier rotation of the body 63. The control member 62 has a through-hole 64 formed longitudinally through it along the central axis thereof. As shown in FIG. 9, the inner wall of the through-hole 64 has formed therein a guide recess 64*a* to guide the control member 62 being moved along the axis of rotation of the control member 62.

The control member 62 has formed on one longitudinal end thereof around the through-hole 64 an engagement projection 64*b* on which a guide member 65 which will guide the control member 62 being moved along the axis of rotation thereof. Also, the control member 62 has formed on the other longitudinal end thereof a bearing hole (not shown) in which there is engaged a fixing base 69 on which installed is a rotation detector 71 which detects a rotation of the control member 62.

As shown in FIG. 7, the guide member 65 installed on the other longitudinal end face of the control member 62 has a semi-circular guide cut 66 in which the engagement projection 64*b* is engaged. Since the guide member 65 is engaged on a shaft portion 68 of a rotation bearing member 67 which will further be described later, it is movable with the control member 62 along the axis of rotation of the control member 62. The guide member 65 has formed therein guide slits 65*a* in which arms of a supporting member 74 are engaged.

The rotation bearing member 67 rotatable with the control member 62, consists of a shaft portion 68 which is inserted in the through-hole 64 in the control member 62, and the above-mentioned fixing base 69 formed integrally with the shaft portion 69 and on which installed is the rotation detector 71 which detects a rotation of the control member 62. The shaft portion 68 is formed nearly equal in diameter to the through-hole 61 in the control member 62, and fitted in the through-hole 68 so that the control member 62 is movable axially thereof. As shown in FIG. 9, the shaft portion 68 has formed thereon a guide projection 68*a* which is engaged in the guide recess 64*a* formed in the inner wall of the through-hole 64. The shaft portion 68 is inserted in the through-hole 64 of the control member 62 with the guide projection 68*a* being engaged in the guide recess 64*a*, and the control member 62 can thus be moved on and axially of the shaft portion 68. With the guide projection 68*a* being engaged in the guide recess 64*a* of the control member 62, the rotation bearing member 67 is rotatable with the control member 62.

The shaft portion 68 has a bearing bore 68*b* formed in the free longitudinal end face thereof. The bearing bore 68*b* is larger in diameter than a spindle provided on a supporting member 74 which will further be described later and on which the rotating supporting member 67 is supported.

Also, the shaft portion 68 has provided integrally therewith the fixing base 69 on which is installed the rotation detector 71 which detects a rotation of the control member 62. The fixing base 69 is designed to have the generally same size as the other longitudinal end face of the control member 62. It has formed on the other longitudinal end face thereof opposite to the other longitudinal end face of the control member 62 an engagement projection which is engaged in the bearing hole formed in the other longitudinal end face of the control member 62. The rotation bearing member 67 is engaged at the engagement projection thereof in the bearing hole in the control member and the guide projection 68*a* is engaged in the guide recess 64*a*, so that the rotation bearing member 67 is rotatable along with the control member 62.

The fixing base 69 has provided on the other side thereof the rotation detector 71 which is rotated with the control member 62 and rotation bearing member 67 and detects a rotation of the control member 62. The rotation detecting member 71 has a contact shoe provided on a side thereof opposite to a supporting member 73 supporting the rotation bearing member 67 on which the control member 62 is installed. The contact shoe is in sliding contact with contacts (not shown) provided on the side of the supporting member 73 opposite to the contact shoe. Also, the rotation supporting element 71 has provided in the center of the side thereof opposite to the supporting member 73 a spindle 71*a* which is engaged in a bearing hole formed in the supporting member 73. The spindle 71*a* is formed to have an outside diameter smaller than the diameter of the bearing hole in the supporting member 73. Thus, the spindle 71*a* is loose-fitted in the bearing hole, so it is movable in a direction perpendicular to the shaft portion 68.

The control member 62 fitted on the rotation bearing member 67 is supported by the supporting member 73 and another supporting member 74 as shown in FIGS. 6 thru 7. The supporting member 73 consists of a supporting portion 75 to support he control member 62, and a circuit portion 76 on which detectors to detect a rotation and movement of the control member 62 and terminals for supplying control signals from the detectors to an external circuit. The supporting portion 75 is provided at the free end portion of the supporting member 73. The supporting portion 75 has formed nearly in the center thereof a bearing hole 77 in which the control member 62 is supported rotatably about the axis of rotation thereof and movable in a direction perpendicular to the shaft portion 68 of the rotation bearing member 67, namely, in the directions of arrow A in FIG. 8 and in a direction opposite to the direction of arrow A. The spindle 71 a provided on the rotation detector 71 is engaged in the bearing hole 77. The bearing hole 77 is formed larger in diameter than the spindle 71*a* of the rotating detector 71 so as to bear the rotation bearing member 67 on which the control member 67 is fitted, rotatably and movably in the direction perpendicular to the shaft portion 68 of the rotation bearing member 67.

There is provided around the bearing hole 77 a plurality of contacts 78 with which the contact shoe of the rotation detector 71 which detects a rotation of the control member 62 is in sliding contact, and thus is electrically connected. The contact shoe of the rotation detector 71 is in contact with any selected one of the contacts 78.

As shown in FIGS. 7 and 8, the circuit portion 76 has provided at the base end of the supporting member 73 and in a position nearly corresponding to the lower end of the control member 62 supported by the supporting member 73, a support base 79*a* which supports a pressure detector 79 which detects a movement of the control member 62 in a direction perpendicular to the shaft portion 68. The support base 79*a* is projected longitudinally of the control member 62 and has the pressure detector 79 disposed on the side thereof opposite to the control member 62. When the control member 62 is pressed, the pressure detector 79 is put in contact with, and pressed, by the body 63 of the control member 62.

The circuit portion 76 has provided at the base end thereof terminals 81 for supplying control signals to the control circuit of the pocket telephone 1 from the rotation and pressure detectors 71 and 77. The terminals 81 are electrically connected to the contacts 78, rotation and pressure detectors 71 and 77 via a wiring pattern (not shown) buried in the supporting member 73.

As described in the above, the supporting member 74 cooperating with the supporting member 73 to support the rotation bearing member 67 consists of a supporting portion 82 which cooperates with the supporting portion 75 of the supporting member 73 to support the control member 62. The supporting portion 82 has provided nearly in the center thereof a spindle 83 which is engaged in the bearing bore 68*b* formed in the one longitudinal end face of the shaft portion 68 of the rotation bearing member 67. The spindle 83 is formed to have a smaller outside diameter than the diameter of the bearing bore 68*b*. Thus, the spindle 83 bears the rotation bearing member 67 movably in a direction perpendicular to the shaft portion 68.

The supporting member 74 is formed to have a generally C-shaped section having a pair of arms 84. Each of the arms 84 is formed at the free end thereof as an engagement end 85. The engagement ends 85 of the arms 85 are engaged on the supporting member 73. The arms 84 are elastically deflectable towards and away from each other. When the engagement ends 85 are engaged on the supporting member 73, the arms 84 will be deflected outwardly. When the spindle 83 of the rotation bearing member 67 having the control member 62 fitted thereon is engaged in the bearing bore 68*b* and the spindle 71*b* of the rotation detector 71 fitted on the rotation bearing member 67 is engaged in the bearing hole 77 in the supporting member 73, the engagement ends 85 of the supporting member 74 are engaged on the supporting member 83. Thus the supporting member 74 cooperates with the supporting member 73 to support the rotation bearing member 67. Note that the arms 84 are engaged in the guide slits 65*a* in the guide member 65.

Further, the switch mechanism 61 comprises a movement detector 86 which detects a movement of the control member 62 on and axially of the shaft portion 68 of the rotation bearing member 67, namely, in the direction of arrow B in FIG. 8 and in a direction opposite to the direction of arrow B. The movement detector 86 is installed on a base 86*a* provided integrally with the cabinet 2, at the supporting member 73 and in a position where it will be pressed by one side of the control member 62. The movement detector 86 is pressed by the one side of the control member 62 as the movement bearing member 67 on which the control member 62 is fitted is moved in the direction of arrow B in FIG. 8, and thus detects that the control member 62 is pressed in the direction of arrow B in FIG. 8.

Moreover, the switch mechanism 61 comprises a forcing member 87 which provides a detent when he or she moves the control member 62 in the direction of arrow B in FIG. 8. The forcing member 87 is a torsion spring, for example. It rests at one end thereof on an engagement projection (not shown) provided on the supporting member 74 and at the other end on an engagement projection (not shown) provided on the guide member 65, thus forcing, in the direction of arrow B in FIG. 8, the rotation bearing member 67 having the control member 62 fitted thereon.

The switch mechanism 61 constructed as having been described in the foregoing is assembled as will be described below:

First, the shaft portion 68 of the rotation bearing member 67 is inserted into the through-hole 64 of the control member 62 with the guide projection 68*a* provided on and axially of the shaft portion 68 being engaged in the guide recess 64*a* formed in the inner wall of the through-hole 64 of the control member 62. Thus, the control member 62 is fitted movably on and axially the shaft portion 68. The rotation bearing member 67 is installed on the side of the fixing base 69 opposite to the supporting member 73, and the fixing face of the fixing base 68 is installed on one longitudinal end face of the control member 62. Thus, the rotation detector 71 is rotatable along with the control member 62 to detect a rotation of the latter. Further, the guide member 65 is installed on the other longitudinal end face of the control member 62.

The rotation bearing member 67 on which the control member 62 and rotation detector 71 are thus supported by the supporting members 73 and 74. The spindle 71*b* of the rotation detector 71 is engaged in the bearing hole 77 in the supporting member 73, and the spindle 83 of the supporting member 74 is engaged in the engagement bore 68*b* in the shaft portion 68 of the rotation bearing member 67. With the arms 84 enclosing the control member 62 and engagement ends 85 being engaged on the supporting member 73, the supporting member 74 is installed to the supporting member 73 and thus works with the latter to support the rotation bearing member 67. Thus, the rotation bearing member 67 supporting the control member 62 is supported by the supporting members 73 and 74 rotatably as well as movably in a direction perpendicular to the shaft portion 68 of the rotation bearing member 67, namely, in the direction of arrow A in FIG. 8 and in a direction opposite to the direction of arrow A. Thereafter, the forcing member 87 is fitted on the supporting member 74 and guide member 65. The rotation bearing member 67 on which the control member 62 is forced by the forcing member 87 in a direction opposite to the direction of arrow B in FIG. 8.

Note that the rotation bearing member 67 on which the control member 62 is fitted may be forced by the forcing member 87 in the direction of arrow B in FIG. 8 to provide a detent when the control member 61 is operated. In this case, the forcing member should rest at one end thereof on the supporting member 73 and at the other end on the rotation bearing member 67.

In the switch mechanism 61 assembled as in the above, the control member 62 is forced by the forcing member 87 in the direction opposite to the direction of arrow B in FIG. 8, not pressing the movement detector 86. In this condition, the rotation bearing member 67 having the control member 62 fitted thereon is rotatably supported by the supporting members 73 and 74. Therefore, the control member 62 can be rotated reciprocally, namely, in the direction of arrows C in FIG. 6. As the control member 62 is rotated, the contact shoe of the rotation detector 71 is in contact with a selected one of the contacts 78 on the supporting member 73 and thus a first control signal corresponding to the rotation of the control member 62 is supplied to the terminals 81 via which the control signal is supplied to the control circuit of the pocket telephone 1. The rotation of the control member 62 is thus detected.

The control member 62 can be pressed in the direction of arrow A in FIG. 8, perpendicular to the shaft portion 68 of the rotation bearing member 67. Since the spindles 71*b* and 83 are loose-fitted in the bearing bore 68*b* and bearing hole 77, respectively, the control member 62 is movable in the direction of arrow A in FIG. 8 to press the pressure detector 79. As the pressure detector 79 is thus pressed by the control member 62 moved in the direction of arrow A in FIG. 8, a second control signal corresponding to the movement of the control member 62 in the direction of arrow A in FIG. 8 is supplied to the terminals 81 via which the control signal is supplied to the control circuit of the pocket telephone 1. The movement of the control member 62 in the direction of arrow A is thus detected.

Further, in the switch mechanism 61, by moving the control member 62 axially of the shaft portion 68 of the rotation bearing member 67 on which the control member 62 is fitted, that is to say, in the direction of arrow B in FIG. 8, it is possible to select a desired one of the functions of the pocket telephone 1. More specifically, since the guide projection 68*a* is engaged in the guide recess 64, the control member 62 moved in the direction opposite to the direction of arrow B in FIG. 8 will press the movement detector 86 and thereafter it will be forced by the forcing member 87 in the direction of arrow B in FIG. 8. As the movement detector 86 is thus pressed, a third control signal corresponding to the movement of the control member 62 in the direction of arrow B in FIG. 8 is supplied to the control circuit of the pocket telephone 1. Thus this movement of the control member 62 is detected. Also, in this condition, the control member 62 can be moved in the directions of arrows A and B as having been described above, and also rotated in the directions of arrow C in FIG. 6.

As mentioned above, the switch mechanism 61 uses the control member 62 whose axis of rotation is longitudinal. Thus, the control member 62 may be designed with sufficient size for easier operability. Also, since in the switch mechanism 61, the control member 62 is supported at the opposite longitudinal ends thereof on the supporting members 73 and 74, even when it is pressed, no excessive force will be applied to the spindles 71*b* and 83. Therefore, the control member 62 can be prevented from being disengaged from the supporting members 73 and 74. Further, since in the switch mechanism 61, all the electronic parts such as the rotation detector 71, pressure detector 79, movement detector 86, terminals 81, etc. are disposed on the supporting member 73, the switch mechanism 61 can be designed simple and compact. Furthermore, since the switch mechanism 61 can be operated in the aforementioned three different directions, many functions can be selected by the single controller. Morever, different from the previously mentioned switch mechanism 10, the arms 84 are provided on the supporting member 74 in the switch mechanism 61, so no fastening member 35 has to be provided. Thus, the number of parts for the switch mechanism 61 can be reduced, which will lead to a lower manufacturing cost and a more compact design of the switch mechanism 61.

Figure 10:
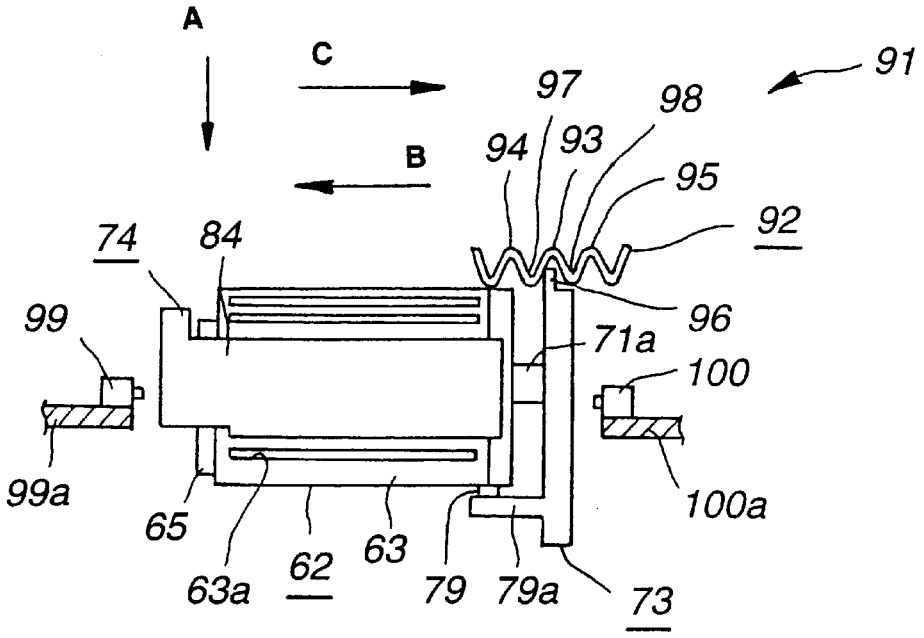
FIG. 10 is a side elevation of a still another variant of the switch mechanism in FIG. 6.

Referring now to FIG. 10, there is illustrated a variant of the aforementioned switch mechanism 61. This switch mechanism is generally indicated with a reference 91. The switch mechanism 91 is characterized in that the control member 62 can be moved on and axially of the shaft portion 68 in three steps. Note that in FIG. 10, the same elements as those uses in the aforementioned switch mechanism 61 will be indicated with the same reference numerals as in FIGS. 6 to 9, and will not be described any further.

As shown in FIG. 10, the switch mechanism 91 comprises a leaf spring 92 on which the free end of the supporting member 73 is engaged, in place of the forcing member 87 in the aforementioned switch mechanism 61. The leaf spring 92 has an engagement concavity 93 at the middle thereof and also engagement concavities 94 and 95 adjacent to the engagement concavity 93. The engagement concavity 93 provides a neutral position, and the engagement concavities 94 and 95 provide first and second positions, respectively. These engagement concavities 93, 94 and 95 are formed by folding the leaf spring 92. The free end of the supporting member 73 is terminated by a projection 96. The projection 96 is engaged in a selected one of the concavities 93, 94 and 59. That is to say, as the control member 62 is moved in the directions of arrows B and C in FIG. 10, the projection 96 will elastically deflect a projection 97 formed between the engagement concavities 93 and 94 and a projection 98 formed between the 93 and 95, and be thus engaged in a selected one of the engagement concavities 93, 94 and 95. Thus, in the switch mechanism 91, the control member 62 provides a detent when it is moved in the directions of arrows B and C in FIG. 10.

Also, the switch mechanism 91 comprises movement detectors 99 and 100 to detect the position of the control member 62. The movement detector 99 is supported on a base 99*a* formed integrally with the cabinet 2, and pressed by the control member 62 as the latter is moved in the direction of arrow B in FIG. 10. The movement detector 100 is supported on a base 100*a* formed integrally with the cabinet 2, and pressed by the control member 62 when the latter is moved in the direction of C in FIG. 10. Thus, the movement detector 99 will detect that the projection 96 is engaged in the engagement concavity 94 (first position), while the movement detector 100 will detect that the projection 96 is engaged in the engagement concavity 95 (second position). When the control member 62 is in the neutral position, the movement detectors 99 and 100 are not pressed.

In the switch mechanism 91 constructed as described in the above, the control member 62 can be rotated reciprocally as in the switch mechanism 61 having previously been described. Also, in the switch mechanism 91, the control member 62 can be pressed in the direction of arrow A in FIG. 10. Further, in the switch mechanism 91, the control member 62 can be moved in the directions of arrows B and C in FIG. 10. That is, in the switch mechanism 91, when the projection 96 is moved in the direction of arrow B in FIG. 10 from its neutral position where the projection 96 is engaged in the engagement concavity 93, the projection 96 will elastically deflect the projection 97 of the leaf spring 92, and be engaged into the engagement concavity 94. At this time, the user will feel a click when the projection 97 is elastically deflected by the projection 96.

The movement detector 99 is pressed by the control member 62 to detect that the control member 62 is in the first position. When the projection 96 is moved from the neutral position where it is engaged in the engagement concavity 93 in the direction of arrow C in FIG. 10, the projection 96 will elastically deflect the projection 98 of the leaf spring 52 and be thus engaged into the engagement concavity 95. As the projection 96 elastically deflects the projection 98, the user will feel a clock. Thus, the movement detector 100 detects that the control member 62 is in the second position.

When the control member 62 is in its neutral position, both the movement detectors 99 and 100 are not pressed. Also, when the control member 62 is moved from its first or second position to neutral position, the projections 97 and 98 are elastically deflected by the projection 96 and the user will feel a click.

The aforementioned switch mechanism 91 forms one controller for the pocket telephone 1. By moving the control member 62 in a selected one of the three different directions, it is possible to select a desired one of the functions of the pocket telephone 1. Since any one of the neutral, first and second positions can be selected by moving the control member 62 in any of the directions of arrows B and C in FIG. 10, more functions of the pocket telephone 1 can selectively be used than with the switch mechanism 61 by operating the single controller.

Figure 11:
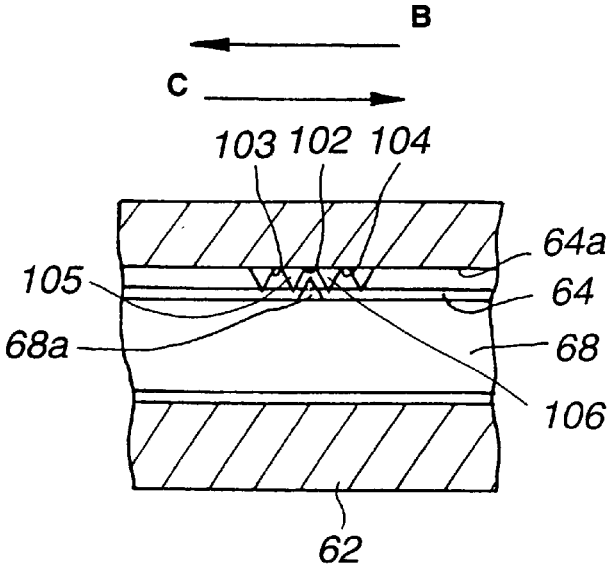
FIG. 11 is a sectional view of a variant of the control member used in the switch mechanism in FIG. 10.

Referring now to FIG. 11, there is illustrated a variant of the aforementioned switch mechanism 91. This switch mechanism is generally indicated with a reference 101. It is characterized in that the control member 62 can be moved axially of the shaft portion 68 in three steps. Note that in FIG. 11, the same elements as in the switch mechanism 61 are indicated with the same reference numerals as in the switch mechanism 61.

As shown, the switch mechanism 101 uses in place of the leaf spring 92 a plurality of engagement concavities 102, 103 and 104 in the guide recess 64*a* formed in the inner wall of the through-hole 64 of the control member 62. When the control member 62 is in the neutral position, the guide projection 68*a* is engaged in the neutral-position engagement concavity 102. When the control member 62 is in the first position where it pressed the movement detector 99, the guide projection 68*a* is engaged in the engagement concavity 103 adjacent to the engagement concavity 102. When the control member 62 is in the second position where it presses the movement detector 100, the guide projection 68*a* is engaged in the engagement concavity 104 adjacent to the engagement cavity 102. There are provided elastically deflectable projections 105 and 106 between the two successive ones of the engagement concavities 102, 103 and 104, namely, between the engagement concavities 103 and 102 and between the engagement concavities 102 and 104, respectively. The projections 105 and 106 are pressed and elastically deflected by the guide projection 68*a* on the shaft portion 68, providing a detent (clicking).

In the switch mechanism 101, the control member 62 can be moved in the directions of arrows B and C in FIG. 11. More specifically, as the control member 62 is moved in the direction of arrow B in FIG. 10 from the neutral position where the guide projection 68*a* is engaged in the engagement concavity 102, the guide projection 68*a* elastically deflects the projection 105 and is engaged into the engagement concavity 103. At this time, the elastic deflection of the projection 105 by the guide projection 68*a* will provide a detent. The movement detector 99 is pressed by the control member 62, and the latter detects that the latter is in the first position.

When the control member 62 is moved in the direction of arrow C in FIG. 10 from the neural position where the guide projection 68*a* is engaged in the engagement concavity 102, the guide projection 68*a* will elastically deflect the projection 106 and be engaged into the engagement concavity 104. At this time, the elastic deflection of the projection 106 by the guide projection 68*a* will provide a detent. The movement detector 100 is pressed by the control member 62, and the latter detects that the control member 62 is in the second position.

When the control member 62 is in the neutral position, neither the movement detector 99 nor the movement detector 100 is not pressed. Also when the control member 62 is moved from the first or second position to the neutral position, the projections 105 and 106 will elastically be deflected by the guide projection 68*a*, providing a detent.

The aforementioned switch mechanism 101 forms one controller for the pocket telephone 1. By moving the control member 62 in a selected one of the three different directions, it is possible to select a desired one of the functions of the pocket telephone 1. Since any one of the neutral, first and second positions can be selected by moving the control member 62 in any of the directions of arrows B and C in FIG. 11, more functions of the pocket telephone 1 can selectively be used than with the switch mechanism 61 by operating the single controller. Since the plurality of engagement concavities 102, 103 and 104 is provided in the guide recess 64*a* in the through-hole 64 of the control member 62, the switch mechanism 101 can be designed more compact.

In the foregoing, the present invention has been described concerning the pocket telephone 1 in which the switch mechanism 10 is used. However, it should be reminded that the present invention is not limited to this application, but may be applied to switch mechanisms used in electronic apparatuses such as disc recording and/or reproducing apparatus, etc. In case the switch mechanism according to the present invention is applied in a disc recording and/or reproducing apparatus, it can be used to control the sound volume, track jump, etc. Also, the detectors may be formed from a variable resistor to move the control member along the axis of rotation in many steps. Thus, functions of many electronic apparatuses can selectively be performed.

What is claimed is:

1. A switch mechanism, comprising:

a control member mounted for rotation;

a supporting member for supporting the control member rotatably and movably in a direction perpendicular to an axis of rotation of the control member, wherein the supporting member is movable in a direction along the axis of rotation of the control member;

a first detector for detecting a rotation of the control member;

a second detector for detecting a movement of the control member in the direction perpendicular to the axis of rotation of the control member; and a third detector for detecting a movement of the supporting member in the direction along the axis of rotation of the control member.

2. The switch mechanism as set forth in claim 1, wherein the supporting member includes:

a plurality of supporting portions for supporting the control member rotatably and movably in the direction perpendicular to the axis of rotation of the control member.

3. The switch mechanism as set forth in claim 2, further comprising:

means for urging the control member in the direction along the axis of rotation of the control member.

4. The switch mechanism as set forth in claim 2, further comprising:

a leaf spring having a continuously zigzag cross section and disposed along the axis of rotation of the control member, at least one of the plurality of supporting portions being partially engaged in a valley along a length of the leaf spring.

5. A switch mechanism comprising:

a control member mounted for rotating;

a shaft portion inserted into a through-hole formed in the control member along an axis of rotation of the control member and a plurality of supporting portions for supporting the shaft portion rotatably and movable in a direction perpendicular to the axis of rotation of the control member, wherein the control member rotates together with the shaft portion and moves along the shaft portion;

a first detector for detecting a rotation of said control member;

a second detector for detecting a movement of said control member in a direction perpendicular to the axis of rotation of the control member; and a third detector for detecting a movement of the supporting member in a direction along the axis of rotation of the control member.

6. The switch mechanism as set forth in claim 5, further comprising:

means for urging the control member in the direction along the axis of rotation of the control member.

7. The switch mechanism as set forth in claim 5, further comprising:

a leaf spring having a continuously zigzag section and disposed along the axis of rotation of the control member, at least one of the plurality of supporting portions being partially engaged in a valley along a length of the leaf spring.

* * * * *